United States Patent [19]

Mefford et al.

[11] Patent Number: 5,048,793

[45] Date of Patent: Sep. 17, 1991

[54] PIPE JACK

[75] Inventors: John B. Mefford, Madison; Bob G. Scott, Brownsburg; Jesse W. Cotherman, Camby, all of Ind.

[73] Assignee: Miller Pipeline Corporation, Indianapolis, Ind.

[21] Appl. No.: 537,621

[22] Filed: Jun. 14, 1990

[51] Int. Cl.[5] ..... E21B 19/00

[52] U.S. Cl. ..... 254/29 R

[58] Field of Search ..... 254/29 R, 30; 29/237, 29/280, 282; 269/43; 228/49.3; 61/72.7, 72.1, 72.5; 175/62; 173/152

[56] References Cited

U.S. PATENT DOCUMENTS

| | | | |
|---|---|---|---|
| Re. 29,364 | 8/1977 | Robley . | |
| 409,008 | 8/1889 | Breymann . | |
| 870,931 | 11/1907 | Claiborne . | |
| 889,315 | 6/1908 | Kenyon . | |
| 968,022 | 8/1910 | Abbott et al. . | |
| 1,167,565 | 1/1916 | Jackson . | |
| 2,060,214 | 11/1936 | Hitchens | 254/29 R |
| 2,935,298 | 5/1960 | Wilwerding . | |
| 3,036,372 | 5/1962 | Vigneron . | |
| 3,227,419 | 1/1966 | Lackey . | |
| 3,233,315 | 2/1966 | Levake . | |
| 3,267,682 | 8/1966 | Robley . | |
| 3,639,967 | 2/1972 | Brighton . | |
| 3,726,506 | 4/1973 | Vanderwaal et al. . | |
| 3,834,668 | 9/1974 | Casey . | |
| 3,995,829 | 12/1976 | Foik . | |
| 4,020,641 | 5/1977 | Takada . | |
| 4,024,721 | 5/1977 | Takada et al. . | |
| 4,403,890 | 9/1983 | Miyanagi et al. . | |
| 4,455,107 | 6/1984 | Schosek . | |
| 4,746,096 | 5/1988 | Donnell et al. . | |

*Primary Examiner*—Robert C. Watson

*Attorney, Agent, or Firm*—Barnes & Thornburg

[57] ABSTRACT

An apparatus is provided for handling a pipe to be used in a pipeline replacement operation or the like. The apparatus includes upper and lower semicircular pipe-gripping sections slidably received on a base and drive pistons connected to the lower pipe-gripping section for moving the pipe-gripping sections from a pipe-releasing position to a pipe-gripping position and then to extended positions in which the gripped pipe has been moved axially with respect to the base. The apparatus also includes a collar affixed to the base for receiving a pipe from the pipe-gripping sections. The collar includes offset cams movable between a first position allowing axial movement of the pipe in an axially forward direction and an axially rearward direction and a second position allowing movement only in the axially forward direction.

35 Claims, 3 Drawing Sheets

PIPE JACK

BACKGROUND OF THE INVENTION

This invention relates generally to devices for joining segments of pipe and moving the joined pipe into an existing underground cavity. More particularly, the invention relates to mechanisms adjustable between engaging and non-engaging positions for moving pipe segments and for controlling the movement of pipe segments therethrough. The invention is of particular utility in connection with the replacement of water and sewer mains, although it can also be adapted for use in a wide variety of operations involving pipeline replacement, repair, and construction.

In pipeline replacement operations it is often impractical and infeasible to dig a trench along the entire length of the pipeline to be replaced. Instead, a trenchless method of pipeline replacement is used. In such a method, short access trenches are dug or existing manholes are employed at either end of the pipeline to be replaced. A pipe mole or the like is inserted, by way of one of the manholes, into the buried pipe. The pipe mole fractures the buried pipe into a series of fragments and displaces the fragments radially outwardly to create a void for the insertion of a replacement pipeline. As the pipe mole progresses along the length of the buried pipe, it tows behind it mated segments of the replacement pipe, placing the replacement pipe into position in the newly-created void.

In order to facilitate such a replacement operation, it is necessary to provide an apparatus for continuously feeding and joining new pipe segments to the trailing end of the replacement pipe as the pipe mole tows the replacement pipe into position. It is desirable that the apparatus be designed so as to fit into the manhole, where it can receive new segments of the replacement pipe and join them directly to the trailing end of the replacement pipe. Furthermore, the apparatus is preferably designed to be easy to disassemble, such that it can be conveniently transported to the job site, easily inserted into the manhole, and readily repaired or adjusted, if necessary, at the site.

It is also desirable to design the apparatus so that it minimizes axial recoil movement of the new segment of the replacement pipe. Such axial recoil is likely to be encountered when a new segment of pipe is mated to the trailing end of a buried replacement pipe. The buried replacement pipe can act as a spring when longer pipe lengths are reached. If not kept under compression, the pipe will yield when a new segment of pipe is joined.

Prior art devices for handling pipes have suffered certain deficiencies, particularly in the context of pipeline replacement operations. For example, while prior art devices have a variety of lever-actuated grip mechanisms or cooperating camming grip mechanisms for joining and moving pipe segments, such devices have not heretofore satisfactorily addressed the needs characteristic of pipeline replacement operations, such as recoil minimization, compactness, ease of installation, and ease of assembly.

SUMMARY OF THE INVENTION

According to the present invention, a pipe-handling apparatus is provided for moving a pipe and controlling the movement of the pipe in a pipeline replacement operation. The pipe-handling apparatus includes a base and accepting means affixed to the base for accepting a pipe. The apparatus also includes moving means reciprocable relative to the base for moving the pipe axially with respect to the accepting means In addition, the apparatus includes controlling means for controlling the axial movement of the pipe relative to the accepting means.

The controlling means is movable between a first and a second position. When moved to the first position, the controlling means is out of engagement with the pipe and allows movement of the pipe in either axial direction. When moved to the second position, the controlling means engages the pipe, continuing to allow the pipe to move in one axial direction but preventing the pipe from moving in an opposite axial direction.

In a preferred embodiment, the moving means includes gripping means movable relative to the base for gripping the pipe. The moving means also preferably includes at least one drive piston movable between an extended position and a retracted position through intermediate positions and adjusting means cooperating with the at least one drive piston for adjusting the gripping means between a pipe-gripping position and a pipe-releasing position. The pipe-gripping position corresponds to an intermediate position of the at least one piston while the pipe-releasing position corresponds to the retracted position of the at least one piston. That is, when the drive piston is retracted, the moving means is positioned out of engagement with the pipe. The drive piston then extends to an intermediate position at which the moving means engages the pipe. The drive piston can then extend beyond the intermediate position to a fully extended position. The moving means remains in engagement with the pipe and therefore moves the pipe as the drive piston moves from the intermediate to the extended position.

One feature of a preferred embodiment of the present invention is a pair of offset cams having the advantage of allowing movement of the pipe in either axial direction when the cams are in a first position out of engagement with the pipe, but preventing axial recoil when the cams are in a second position engaging the pipe.

Another feature of a preferred embodiment of the present invention is a pair of pivot arms which have the advantage translating reciprocating movement of two drive pistons into pipe-gripping or pipe-releasing movement of upper and lower semicircular pipe-gripping sections.

The above-noted features and advantages of the invention along with additional features and advantages will become apparent to those skilled in the art upon consideration of the following detailed description of a preferred embodiment exemplifying the best mode of carrying out the invention as presently perceived. The detailed description particularly refers to the accompanying figures.

DESCRIPTION OF PREFERRED EMBODIMENTS

Figure 1:
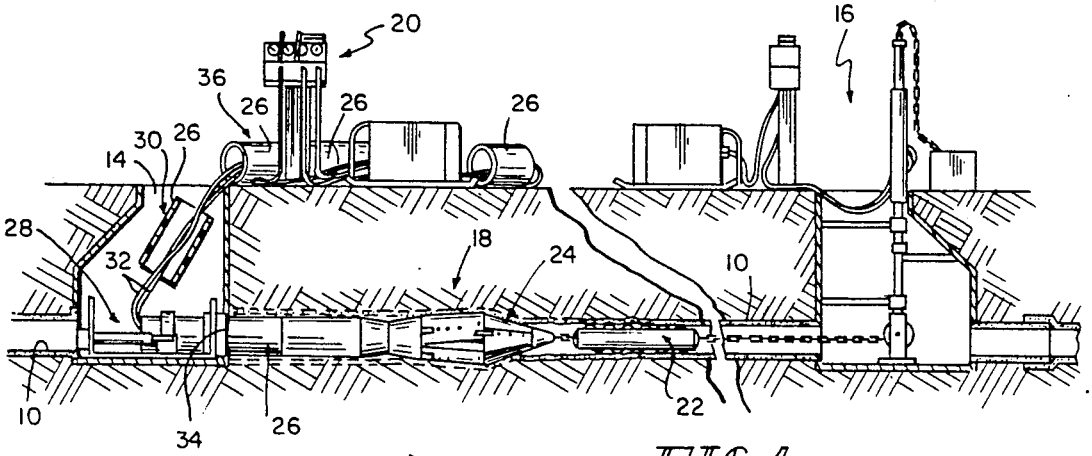
FIG. 1 is a plan view showing a preferred embodiment of the claimed pipe-handling apparatus being used in conjunction with a pipe mole in a typical pipeline replacement operation.

A plan view is shown in FIG. 1 of a preferred embodiment of a pipe-handling apparatus used in a typical pipeline replacement operation in accordance with the present invention. An underground pipe 10 of indefinite length is sought to be replaced. Manholes 14, 16 are accessed on either end of the segment to be replaced. A pipe mole 18 or the like typically having hydraulic controls 20 is inserted into manhole 14. As shown in FIG. 1, fracturing portion 22 of pipe mole 20 fractures the underground pipe into a series of irregular fragments. Then, an expanding portion 24 spreads the fragments radially outwardly to create a void for receiving a replacement pipe 26. Expanding portion 24 is advantageously configured for attachment to replacement pipe 26 such that as expanding portion 24 moves through underground pipe 10, it tows replacement pipe 26 into position in the newly-created void.

As FIG. 1 shows, a pipe-handling apparatus 28 in accordance with the present invention is inserted into manhole 14. A new segment 30 of replacement pipe is fed into the trench about hydraulic lines 32 and placed into pipe-handling apparatus 28. Pipe-handling apparatus 28 is then actuated to join new segment 30 to the trailing end 34 of replacement pipe 26. Advantageously, as described in detail below, pipe-handling apparatus 28 is adjustable to prevent recoil of replacement pipe 26. Pipe mole 18 is then actuated to tow replacement pipe 26 further toward manhole 16, thus clearing pipe-handling apparatus 28 for receipt of another replacement pipe segment 36.

Figure 2:
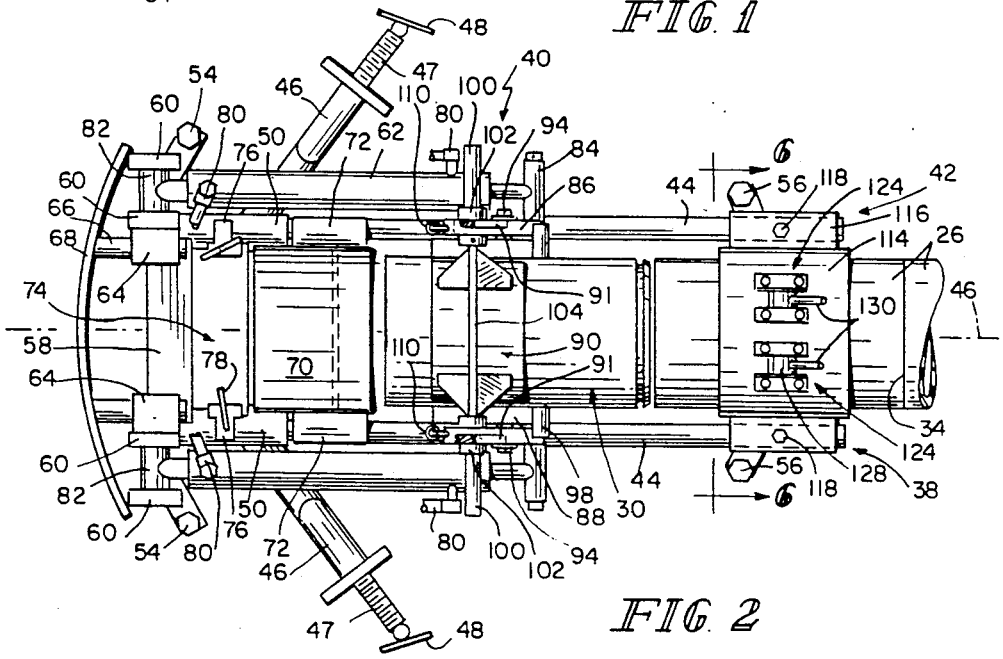
FIG. 2 is a top view of a preferred embodiment of the claimed invention.

As shown in FIG. 2, a pipe-handling apparatus 28 includes a base 38, a pipe-moving mechanism 40, and a pipe movement controlling mechanism 42. Base 38 includes a pair of parallel support rods 44 extending parallel to a longitudinal axis 46 of replacement pipe 26. Base 38 also is shown to include a pair of angularly-extending adjustable braces 46 including footpads 48. Braces 46 can be adjusted by manipulating threaded sleeves 47 so that the braces 46 engage an interior wall of a manhole or the like and brace pipe-handling apparatus 28 against such wall. Alternatively, threaded sleeves 47 may be replaced by hydraulic cylinders for faster and easier assembly. Braces 46 are received on support rods 44 by way of sleeves 50 which are mounted on either support rod 44. Such sleeves 50 include angularly extending stubs 52 (shown in FIG. 3) onto which braces 46 can be engaged.

Figure 3:
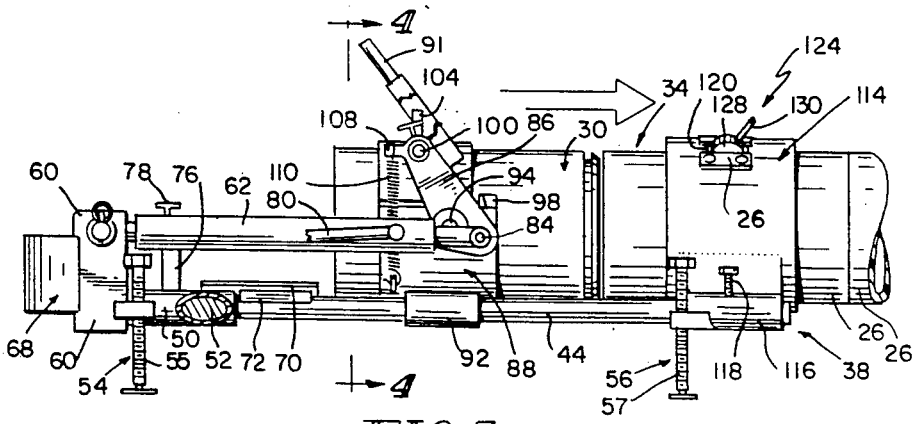
FIG. 3 is a side view of a preferred embodiment of the claimed invention.

As shown best in FIG. 3, base 38 also includes rear legs 54 adjustable by way of threaded sleeves 55. Front legs 56 integral with controlling mechanism 42 and adjustable by way of threaded sleeves 57 are also provided. Alternatively, hydraulically-actuated front and rear legs may be provided.

Base 38 also is shown in FIG. 2 to include a rear crosspiece 58 extending between support rods 44 and having upstanding flanges 60 for mounting a pair of drive pistons 62 of moving mechanism 40 as is hereinafter described. A pair of sleeves 64 for receiving stubs 66 of a curved rear brace plate 68 is integral with crosspiece 58. Integral with crosspiece 58, as is the case with adjustable braces 46, curved rear brace plate 68 is designed to engage the interior wall of a manhole, access trench or the like to minimize unwanted movement of pipe-handling apparatus 28 during operation. Alternatively, rear brace plate 68 can be replaced by a pair of hydraulic cylinders appended directly to flanges 60.

Base 38 also includes a cradle 70 including support tabs 72 to enable cradle 70 to be snap-fit into a space between support rods 44. Cradle 70 is formed to receive at least the axially trailing portion of a pipe segment to allow its convenient introduction to moving mechanism 40. To help retain the axially trailing portion of the new pipe segment in cradle 70, a rear plate 74 is provided. Like curved rear brace plate 68, rear plate 74 includes stubs (not shown) received in sleeves 76. Such sleeves include adjustment bolts 78, enabling rear plate 74 to be tightened in a rearward position as shown or in a variety of more axially forward positions depending upon the length of the stubs.

Advantageously, rear plate 74 and curved rear brace plate 68 can be removed in situations in which it is desired to place in cradle 70 a new pipe segment whose axially trailing end would extend rearwardly beyond curved plate 68. In such case, the axially trailing portion of the new pipe segment is retained by an optional outrigger (not shown) which typically would be affixed directly to the floor of manhole 14.

As shown in FIG. 2, moving mechanism 40 includes a pair of axially-extending hydraulically-actuated drive pistons 62. Hydraulic lines 80 are shown in fragment for clarity. Drive pistons 62 are mounted at their axially rearward ends on piston support rods 82 which are received in upstanding flanges 60 referred to above. At their forward ends, drive pistons 62 are mounted on support rods 84 received in a pivot arm 86.

Figure 4:
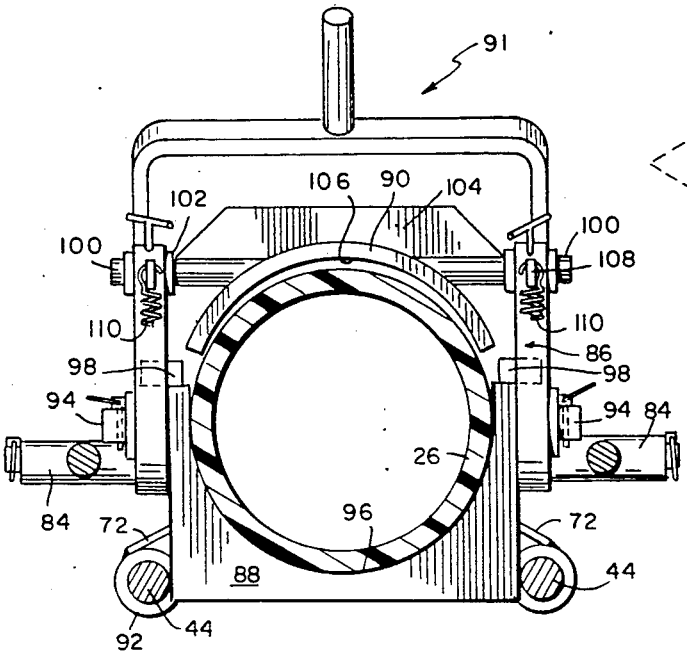
FIG. 4 is a vertical cross-sectional view taken along line 4—4 of FIG. 2 showing the pipe gripping mechanism.

As shown in FIGS. 2-5, and particularly in FIG. 4, moving mechanism 40 also includes a lower semicircular section 88 and an upper semicircular section 90 cooperating to serve as a gripping means adjustable between a pipe-gripping position and a pipe-releasing position. Lower semicircular section 88 is shown to include sleeves 92 by which lower section 88 is slidably received on rods 44. Lower section 88 also includes oppositely-extending support rods 94 received in pivot arms 86 and an inner semicircular surface 96 sized to receive a new pipe segment. Lower section 88 is also formed to include outwardly-extending flanges 98 against which pivot arms 86 engage to assist in moving lower section 88 when drive pistons 62 extend axially forward.

Upper semicircular section 90 is shown likewise to include oppositely extending support rods 100 pivotably received in pivot arms 86 by way of a receiving collar 102. A flange 104 is provided to strengthen upper section 90.

Upper section 90 also includes a handle 91 (shown best in FIG. 4) for easy manual pivoting of upper section 90, which is particularly useful when the operator wishes to position a portion of pipe so that its axially trailing end rests in cradle 70 and its axially leading end lies between lower section 88 and upper section 90, as described hereinafter. For clarity, handle 91 is shown only in fragment in FIGS. 2, 3, and 5.

Figure 5:
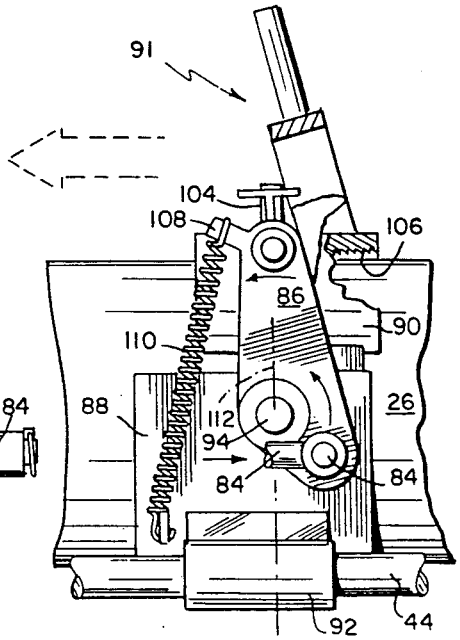
FIG. 5 is a partial side-view of the apparatus of FIG. 4 showing the gripping mechanism in a pipe-releasing position.
Figure 6:
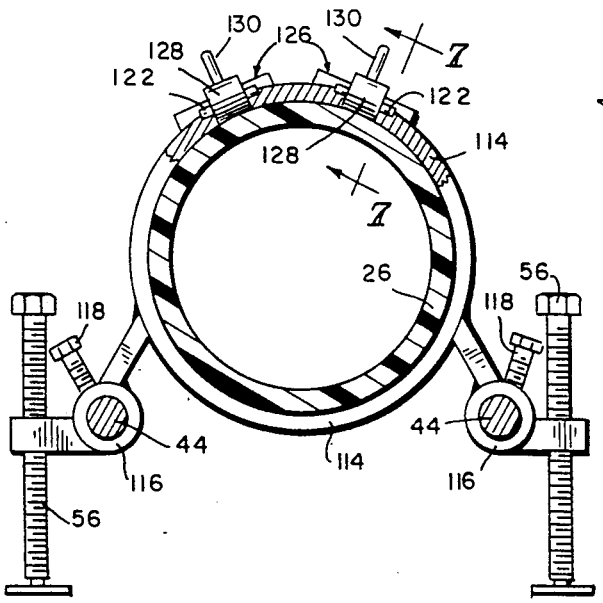
FIG. 6 is a vertical cross-sectional view taken along line 6—6 of FIG. 2 with fragments broken away to show the recoil-prevention mechanism.

Upper section 90 also includes an inner semicircular surface 106 sized for gripping a new pipe segment such that upper section 90 and lower section 88 essentially share a common inner diameter. Inner surface 106 can be serrated for better gripping as shown in FIG. 5.

Pivot arms 86 connect upper section 90 to lower section 88 and pivot to allow upper and lower sections to move axially with respect to each other. Pivot arms 86 serve as means for adjusting the semicircular sections 88, 90 between the pipe-gripping position and pipe-releasing position. Pivot arms 86 also are shown in FIG. 3 to include conventional attachment means such as hooks 108 to which are attached springs 110. Springs 110 are also attached to lower section 88 by conventional means. Springs 110 urge upper section 90 into a gripping position (as shown in FIG. 3) in cooperation with lower section 88.

As shown in FIGS. 2–3 and FIGS. 6–7, pipe-handling apparatus 28 can also include a pipe movement controlling mechanism 42, operating in cooperation with moving mechanism 40 to facilitate the joining of new pipe segment 30 to trailing end 34 of the replacement pipe. Controlling mechanism 42 is shown to include a collar 114 sized to serve as an accepting means to receive a pipe segment. Sleeves 116 are provided to enable collar 114 to be slidably received on axially extending rods 44 during assembly of apparatus 28. Bolts 118 are provided so that collar 114 can be non-slidably affixed to rods 44 during operation of apparatus 28.

Collar 114 is also provided with a pair of apertures 120 across which extend axles 122 (shown best in FIGS. 6–7) each supporting an offset cam or brake 124 for rotation thereabout. Brackets 126 are provided adjacent both apertures for receiving axles 122.

Figure 7:
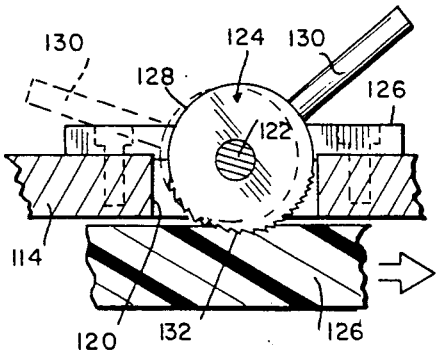
FIG. 7 is a partial cross-sectional view taken along line 7—7 of FIG. 6 showing the recoil prevention mechanism in positions in and out of engagement, respectively, with a pipe.

Offset cams 124 are shown in FIG. 7 to each include a cam body 128 and a lever arm 130 attached to cam body 128. Cam body 128 is shown to include serrated edges 132 for pipe gripping. Advantageously, cam body 128 is formed to receive axle 122 in an off-center position, so that the outer periphery of cam body 128 is spaced asymmetrically from axle 122.

In operation of moving mechanism 40, new segment 30 of replacement pipe 26 is positioned so that its axially leading end rests in lower section 88 and its axially trailing end preferably rests in cradle 70. Moving mechanism 40 is initially in a pipe-releasing position illustrated in FIG. 5. In such a position, drive pistons 62 are retracted. As shown in FIG. 5, retraction of drive pistons 62 pulls piston support rods 84 in an axially rearward direction, swinging pivot arms 86 such that upper section support rods 100 and lower section support rods 94 are aligned with each other along a centerline 112. This in turn places upper section 90 in a position slightly axially forward of lower section 88 and places springs 110 in an extended, inactive position such that upper section 90 is out of engagement with new pipe segment 30.

Next, drive pistons 62 are hydraulically actuated to extend axially forward to an intermediate position (shown in FIG. 3). Such extension of drive pistons 62 pushes piston support rods 84 axially forward, thus swinging pivot arms 86 axially forward to take upper section support rods 100 and lower section support rods 94 out of vertical alignment. In this position, springs 100 are in a contracted, active position in a plane normal to the plane containing the longitudinal axis 46 of the pipe. Thus, springs 110 bias upper section 90 into a pipe-gripping position in which upper section 90 is axially rearward relative to lower section 88.

Next, drive pistons 62 are extended axially forward beyond intermediate positions. Such extension is once again translated to pivot arms 86 by piston support rods 84. However, pivot arms 86 can no longer swing, but rather cam against flanges 98 to slide lower section 88 axially forward along axially parallel rods 44 of base 38, pulling upper section 90 and gripped new pipe segment 30 along with it. When the gripped pipe segment 30 is moved to the desired position, the piston is retracted. Such retraction causes upper section 90 in cooperation with lower section 88 to return to the pipe-releasing position illustrated in FIG. 5.

In operation of controlling mechanism 42, trailing end 34 of replacement pipe 26 is positioned so as to lie within collar 114 (as shown in FIGS. 2–3). New pipe segment 30, which is formed to be mateable with trailing end 34, is positioned in moving mechanism 40 as has previously been described. Because of pressure exerted on replacement pipe 26 by moving mechanism 40, it is recognized that trailing end 34 is likely to recoil upon retraction of moving mechanism 40. To minimize such recoil, lever arms 130 of offset cams 124 are moved to rotate offset cams 124 to a pipe-engaging position shown in shadow in FIG. 7. Offset cams 124 rotate eccentrically to minimize movement in the axially rearward direction while allowing movement in the axially forward direction.

Thus, when moving mechanism 40 is actuated to move new segment 30 into mated engagement with trailing end segment 34 as has been previously described, offset cams 124 are placed in the pipe-engaging position to prevent undesirable recoil.

Offset cams 124 can be rotated so as to be placed out of engagement with trailing end segment 34 as shown in FIG. 7. In such position, offset cams 124 allow movement of trailing end 34 in either axial direction. However, in normal operation, offset cams 124 can be simply left in the pipe-engaging position in which axially forward movement of the pipe is allowed. In either case, when pipe mole 18 is actuated to move axially forward, trailing end 34 of replacement pipe, now mated with new segment 30, can be conveniently towed into the void created by pipe mole 18. The process can be successively repeated until replacement pipe 26 has been moved into a position to span the entire distance between manholes 14 and 16.

Figure 9:
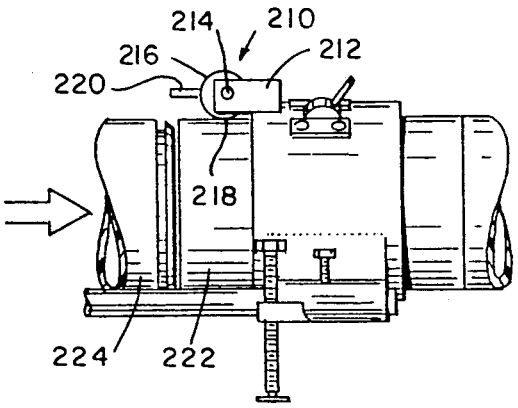
FIG. 9 is a partial side view of the apparatus of FIG. 8 showing the rear brake assembly engaging a pipe segment just prior to mating of the segment with another segment.
Figure 10:
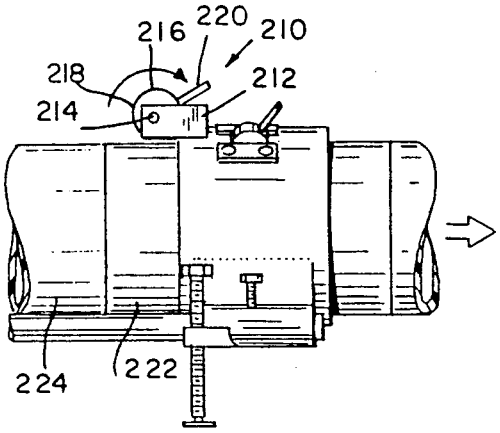
FIG. 10 is a partial side view of the apparatus of FIG. 8 showing the rear brake assembly out of engagement with a pipe segment after mating of the segment with another segment.
Figure 8:
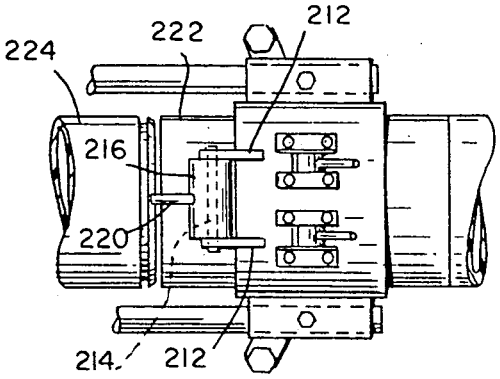
FIG. 8 is a partial top view of a preferred embodiment of the claimed invention showing the rear brake assembly.

Another embodiment of an apparatus in accordance with the claimed invention is illustrated in FIGS. 8–10. In FIGS. 8–10, those elements referenced by numbers identical to those in FIGS. 1–7 perform the same or similar function. In FIG. 8, the apparatus is shown to include a collar 114 having a rear brake assembly 210 appended thereto for restricting axially forward movement of a pipe segment retained in collar 114. Assembly 210 includes a pair of axle support members 212 formed to support an axle 214 for rotation. A cam body 216 is mounted eccentrically on axle 214. Cam body 216 includes serrations 218 for pipe gripping. A lever arm 220 is appended to cam body 216.

Although cam body 216 is shown as roughly cylindrical, it will be understood that alternative geometries are possible. For example, cam body 216 may be formed to have an arcuate surface much like that of collar 114 sized to engage a pipe segment 222.

The operation of rear brake assembly 210 is illustrated in FIGS. 9 and 10. In FIG. 9, a pipe segment 224 is to be mated with pipe segment 222. A moving mechanism of the type heretofore described can be used to move segment 224 into engagement with segment 222 However, pipe segment 222 will tend to move axially forward upon being impacted by pipe segment 224, preventing the pipe segments 222, 224 from being snapped together in sealing, interlocking connection.

Thus, to minimize axially forward movement of pipe segment 222, cam body 216 can be rotated into engagement with segment 222 as shown in FIG. 9. Pipe segment 224 can then be readily driven into engagement with pipe segment 222.

After the pipe segments 222, 224, have been mated, rear brake assembly 210 can be released from engagement with pipe segment 222 by rotation of cam body 216 as shown in FIG. 10. In this configuration, rear brake assembly 216 allows pipe segments to move axially forward so that pipeline replacement can proceed.

Figure 11:
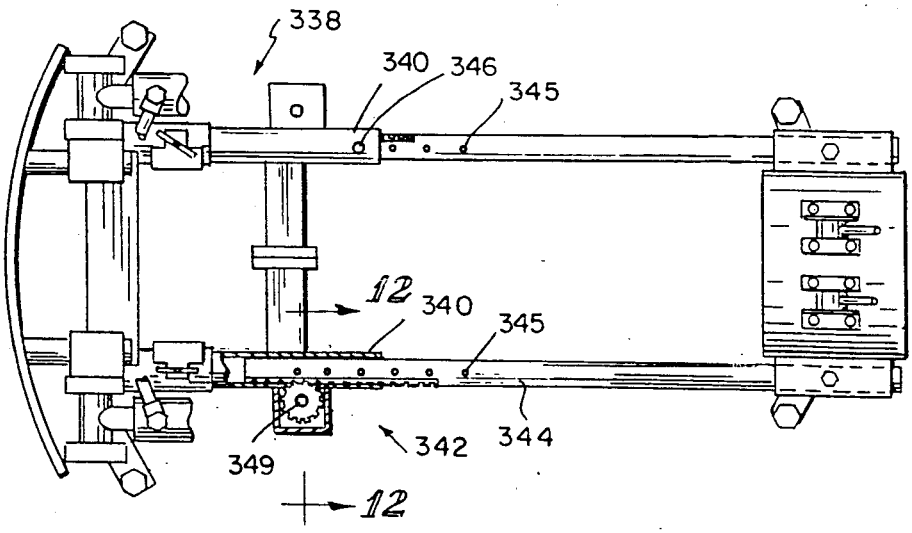
FIG. 11 is a top view with portions broken away showing an alternative embodiment of a pipe jack frame and rack-and-pinion drive system for use in accordance with the present invention.

Turning to FIG. 11, an alternative configuration for a pipe jack frame is shown. While base 38 has been described as including a pair of parallel rods 44 to which sleeves 50 are bolted, alternative configurations for bases or frames are possible. For example, as shown in FIG. 11, a base or frame 338 might be configured to include a pair of parallel rods 344 each slidable in a respective intermediate sleeve 340. Each intermediate sleeve is in turn bolted to sleeve 50. Advantageously each intermediate sleeve can be formed of two pieces which can be easily bolted together on the job site.

Figure 12:
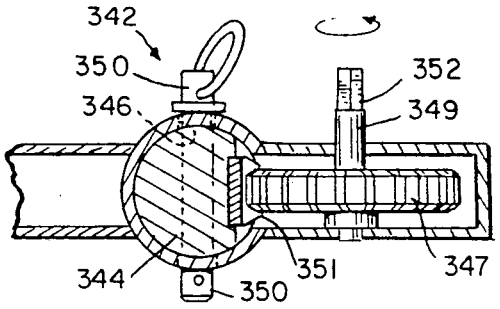
FIG. 12 is a sectional detail view of the rack-and-pinion drive system of FIG. 11 showing an interlocking rack and pinion.

A rack and pinion drive system 342 can be provided to allow each rod 344 to be extended axially relative to each intermediate sleeve 340. Each rod 344 is formed to include a plurality of holes 345. Intermediate sleeve 340 is also formed to include at least one hole 346. Rods 344 are moved axially to a position in which one of the holes 345 on rods 344 align with the at least one hole 346 on each intermediate sleeve 340. A lock pin 350 (shown best in FIG. 12) is then inserted through holes 346 and holes 345 to prevent rods 344 from moving axially with respect to intermediate sleeves 340.

Advantageously, drive system 342 includes a pair of rack and pinion gears 348 to control the axial extension of rods 344 relative to intermediate sleeves 340. As shown best in FIG. 12, pinion 347 is supported for rotation about axle 349 and engages rack 351 formed in each parallel rod 344. Axle 349 is formed to include a square drive socket 353 sized to receive a drive tool (not shown). This feature is of particular advantage during disassembly of the apparatus. By applying the drive tool (not shown) to drive socket 353, a single operator can easily drive rods 344 out of intermediate sleeves 340 in preparation for removing the apparatus from the manhole. In addition, as shown best in FIG. 11, angularly extending stubs 52 for receiving braces 46 are appended to intermediate sleeve 340.

Although the invention has been described in detail with reference to the illustrated preferred embodiments, variations and modifications exist within the scope and spirit of the invention as described and as defined in the following claims.

What is claimed is:

1. A pipe-handling apparatus comprising a base, accepting means for accepting a pipe having an outer diameter, moving means reciprocable relative to the base for moving the pipe axially with respect to the accepting means, and controlling means for controlling the axial movement of the pipe moved by the moving means relative to the accepting means, the controlling means being movable between a first position out of engagement with the pipe allowing the moving means to move the pipe in either axial direction, and a second position engaging the pipe allowing the moving means to move the pipe in a first axial direction but preventing movement of the pipe in an opposite axial direction.

2. The apparatus of claim 1, wherein the controlling means comprises at least one cam and at least one axle supporting the at least one cam for rotation.

3. The apparatus of claim 2, wherein the at least one cam has a peripheral surface spaced asymmetrically from the at least one axle supporting the at least one cam.

4. The apparatus of claim 1, wherein the accepting means comprises a collar having an inner diameter larger than the outer diameter of the pipe.

5. The apparatus of claim 4, wherein the collar includes at least one opening and mounting means for mounting the controlling means to extend through the opening.

6. The apparatus of claim 1, wherein the moving means comprises gripping means movable relative to the base for gripping the pipe, the gripping means being adjustable between a pipe-gripping position and a pipe-releasing position, at least one drive piston movable between an extended position and a retracted position through intermediate positions, and adjusting means cooperating with the at least one drive piston for adjusting the gripping means between the pipe-releasing position corresponding to the retracted position of the piston and the pipe-gripping position corresponding to an intermediate position.

7. A pipe-handling apparatus comprising a base, accepting means for accepting a pipe having an outer diameter, moving means reciprocable relative to the base for moving the pipe axially with respect to the accepting means, the moving means including gripping means movable relative to the base for gripping the pipe, the gripping means being adjustable between a pipe-gripping position and a pipe-releasing position, at least one drive piston movable between an extended position and a retracted position through intermediate positions, and adjusting means cooperating with the at least one drive piston for adjusting the gripping means between the pipe-releasing position corresponding to the retracted position of the piston and the pipe-gripping position corresponding to an intermediate position, the gripping means including a semicircular first section slidably coupled to the base, a semicircular second section movable relative to the first section, the sections having a common inner diameter essentially equal to the outer diameter of the pipe, a first pair of support rods extending oppositely from the first section, and a second pair of support rods extending oppositely form the second section, both support rods supporting the adjusting means, and controlling means for controlling the axial movement of the pipe relative to the accepting means, the controlling means being movable between a first position out of engagement with the pipe allowing axial movement of the pipe in either axial direction and a second position engaging the pipe allowing movement in a first axial direction but preventing movement in an opposite axial direction.

8. The apparatus of claim 7, wherein adjusting means comprises a pair of pivot arms disposed on opposite sides of the first and second sections and pivotable about the first and second pairs of support rods, a pair of springs connecting both pivot arms to the first semicircular sections to bias the second semicircular section toward the pipe-gripping position, and the apparatus further includes a third pair of support rods connected to the pivot arms to support the drive pistons.

9. A pipe-handling apparatus comprising a base having an axially forward end and an axially rearward end, gripping means movable axially forward and rearward relative to the base for gripping a pipe, the gripping means being adjustable between a pipe-gripping position and a pipe-releasing position, and moving means reciprocable axially forward and rearward relative to the base for moving the gripping means with respect to the base in a direction parallel to the longitudinal axis of the pipe, the moving means including at least one drive piston movable between a retracted position and an extended position through intermediate positions, and adjusting means cooperating with at least one drive piston for adjusting the gripping means between the pipe-releasing position corresponding to the retracted position of the drive piston and the pipe-gripping position corresponding to an intermediate position, so that the at least one drive piston extends axially between intermediate and extended positions to cause axial movement of the pipe gripped by the gripping means.

10. The apparatus of claim 9, wherein the gripping means comprises a first and a second semicircular section, the sections being movable relative to each other and having a common inner diameter essentially equal to the outer diameter of the pipe, a first pair of support rods extends oppositely from the first section, and a second pair of support rods extends oppositely from the second section, both pairs of support rods supporting the adjusting means.

11. The apparatus of claim 10, wherein the adjusting means comprises a pair of pivot arms disposed on opposite sides of the first and second sections and pivotable about the first and second pairs of support rods, biasing means connecting each pivot arm to one of the semicircular sections for biasing the gripping means toward the pipe-gripping position, and the apparatus further includes a third pair of support rods connected to the pivot arms to support the drive pistons.

12. The apparatus of claim 11, wherein the first semicircular section is slidably coupled to the base, and the third pair of support rods is located axially forward of the first and second pairs so that when the drive piston extends to the intermediate position, the pivot arms are swung axially forward and the pivot arms cam against the first pair of support rods to slide the first section axially forward to the place the springs in a plane normal to the longitudinal axis of the pipe, thereby orienting the first and second sections in the pipe-gripping position.

13. The apparatus of claim 12, wherein the first semicircular section includes flanges located axially forward of the pivot arms so that the pivot arms cam against the flanges to slide the first semicircular section axially forward when the drive piston extends beyond an intermediate position to the extended position, thereby moving the pipe axially forward.

14. The apparatus of claim 9, further including a collar affixed to the base and sized to accept the pipe from the gripping means, and controlling means for controlling the axial movement of the pipe relative to the collar, the controlling means rotating between a first position out of engagement with the pipe allowing axial movement of the pipe in a first axial direction or in an opposite axial direction and a second position in engagement with the pipe allowing movement in the first axial direction but preventing movement in the opposite axial direction.

15. The apparatus of claim 14, wherein the control means comprises at least one cam and at least one axle supporting the at least one cam for rotation, the cam having a peripheral surface spaced asymmetrically from the at least one axle, the collar having an inner diameter larger than the outer diameter of the pipe and including at least one opening and mounting means for mounting the control means so that the control means extends through the opening.

16. A pipe-handling apparatus comprising a base having an axially forward end and an axially rearward end, gripping means movable axially forward and rearward relative to the base for gripping a pipe, the gripping means being adjustable between a pipe-gripping position and a pipe-releasing position, and moving means reciprocable axially forward and rearward relative to the base for moving the gripping means with respect to the base in a direction parallel to the longitudinal axis of the pipe, the moving means including at least one drive piston movable between a retracted position and an extended position through intermediate positions, and adjusting means cooperating with at least one drive piston for adjusting the gripping means between the pipe-releasing position corresponding to the retracted position of the drive piston and the pipe-gripping position corresponding to an intermediate position, so that the at least one drive piston extends axially between intermediate and extended positions to cause axial movement of the pipe gripped by the gripping means, and means selectively engaging the pipe for restricting the movement of the pipe in the axially forward direction.

17. The apparatus of claim 16, wherein the restricting means comprises at least one cam and at least one axle supporting the at least one cam for rotation between an engaging position restricting axially forward movement of the pipe and a non-engaging position allowing axial movement of the pipe.

18. The apparatus of claim 17, wherein the at least one cam has a peripheral surface spaced asymmetrically from the at least one axle supporting the at least one cam.

19. A pipe-handling apparatus comprising a base having an axially forward and an axially rearward end, gripping means movable axially forward and rearward relative to the base for gripping a pipe, the gripping means being adjustable between a pipe-gripping position and a pipe-releasing position, moving means reciprocable axially forward and rearward relative to the base for moving the gripping means with respect to the base in a direction parallel to the longitudinal axis of the pipe, the moving means including at least one drive piston movable between an extended position and a retracted position through intermediate positions, and adjusting means cooperating with the at least one drive piston for adjusting the gripping means between the pipe-releasing position corresponding to the retracted position of the drive piston and a pipe-gripping position corresponding with the intermediate positions of the drive piston, a collar affixed to the base and sized to accept the pipe from the gripping means, and controlling means for controlling the axial movement of the pipe relative to the collar, the controlling means rotating between a first position out of engagement with the pipe allowing axial movement of the pipe in an axially forward direction and in a axially rearward direction, and a second position engaging the pipe allowing movement in the axially forward direction but preventing movement in the axially rearward direction.

20. The apparatus of claim 19, wherein the controlling means comprises at least one cam and at least one axle supporting the at least one cam for rotation, the cam having a peripheral surface spaced asymmetrically from the at least one axle.

21. The apparatus of claim 19, wherein the collar has an inner diameter larger than the outer diameter of the pipe and includes at least one opening and mounting means for mounting the control means so that the control means extends through the opening.

22. The apparatus of claim 19, wherein the gripping means comprises a first and a second semicircular section, the sections being movable relative to each other and having a common inner diameter essentially equal to the outer diameter of the pipe, a first pair of support rods extends oppositely from the first section, and a second pair of support rods extends oppositely from the second section, both pairs of support rods supporting the adjusting means.

23. The apparatus of claim 22, wherein the adjusting means comprises a pair of pivot arms disposed on opposite sides of the first and second sections and pivotable about the first and second pairs of support rods, a pair of springs connecting each pivot arm to one of the semicircular sections for biasing the gripping means toward its pipe-gripping position, and the apparatus further includes a third pair of support rods connected to the pivot arms to support the drive pistons.

24. The apparatus of claim 23, wherein the first semicircular section is slidably coupled to the base and the third pair of support rods is located axially forward of the first and second pairs so that the pivot arms are swung axially forward and the pivot arms cam against the first pair of support rods to slide the first section axially forward to place the springs in a plane normal to the longitudinal axis of the pipe when the drive piston extends to the intermediate position, thereby orienting the first and second sections in the pipe-gripping position.

25. The apparatus of claim 24, wherein the first semicircular section includes flanges located axially forward of the pivot arms so that when the drive piston extends beyond an intermediate position to the extended position, the pivot arms cam against the flanges to slide the first semicircular section axially forward, thereby moving the pipe axially forward.

26. A pipe-handling apparatus comprising a base, moving means reciprocal relative to the base for moving the pipe axially with respect to the base, and controlling means for controlling the axial movement of the pipe with respect to the base, the controlling means being movable between a first position out of engagement with the pipe allowing the moving means to move the pipe in either axial direction and a second position engaging the pipe allowing the moving means to move the pipe in a first axial direction but preventing movement of the pipe in an opposite axial direction.

27. The apparatus of claim 26, further comprising an accepting means for accepting a pipe, the accepting means being mounted on the base and formed to include an opening, the controlling means extending through the opening formed in the accepting means to selectively engage the pipe and prevent axial movement of the pipe relative to the accepting means.

28. The apparatus of claim 27, wherein the accepting means includes a collar sized to encircle the pipe and formed to include the opening.

29. The apparatus of claim 26, wherein the controlling means comprises at least one cam and at least one axle supporting the at least one cam for rotation.

30. The apparatus of claim 29, wherein the at least one cam has a peripheral surface spaced asymmetrically from the at least one axle supporting the at least one cam.

31. A pipe-handling apparatus comprising means for supporting a pipe segment, means for moving the pipe segment axially with respect to the supporting means in a first direction to insert the pipe segment into an existing underground opening for engagement with an underground pipe therein, and means for selectively preventing axial recoil movement of the pipe segment in a second direction opposite the first direction upon engagement of the pipe segment with the underground pipe, the preventing means being movable between a first position out of engagement with the pipe segment allowing the moving means to move the pipe segment in either axial direction and a second position engaging the pipe allowing the moving means to move the pipe segment in a first axial direction but preventing axial recoil movement of the pipe segment in the second direction.

32. The apparatus of claim 31, further comprising accepting means for accepting a pipe segment, the accepting means being formed to include an opening, the preventing means extending through the opening formed in the accepting means to selectively engage the pipe and prevent axial recoil movement of the pipe relative to the accepting means.

33. The apparatus of claim 32, wherein the accepting means includes a collar sized to encircle the pipe segment and formed to include the opening.

34. The apparatus of claim 31, wherein the preventing means comprises at least one cam and at least one axle supporting the at least one cam for rotation.

35. The apparatus of claim 34, wherein the at least one cam has a peripheral surface spaced asymmetrically from the at least one axle supporting the at least one cam.

* * * * *